US006019891A

United States Patent [19]

Stoner

[11] Patent Number: 6,019,891

[45] Date of Patent: Feb. 1, 2000

[54] DEBRIS VACUUM DEVICE FOR SPAS/HOT TUBS

[76] Inventor: Michael A. Stoner, 1225 Upper Tom Burke, Gallatin Gateway, Mont. 59730

[21] Appl. No.: 08/929,705

[22] Filed: Sep. 15, 1997

Related U.S. Application Data

[60] Provisional application No. 60/027,264, Sep. 25, 1996.

[51] Int. Cl.[7] ..... E04H 3/16; E04H 4/16

[52] U.S. Cl. ..... 210/136; 210/169; 210/232; 210/238; 210/416.2; 210/489; 210/492; 15/1.7; 4/490

[58] Field of Search ..... 210/169, 238, 210/416.2, 232, 136, 483, 488, 489, 492, 416.1; 15/1.7; 4/490, 496; 137/143, 150

[56] References Cited

U.S. PATENT DOCUMENTS

| | | |
|---|---|---|
| 24,551 | 6/1859 | Fontain . |
| 1,480,562 | 1/1924 | Mock . |
| 1,582,399 | 4/1926 | Helander . |
| 2,218,941 | 10/1940 | Thompson . |
| 2,672,987 | 3/1954 | Hutchinson . |
| 2,761,833 | 9/1956 | Ward . |
| 2,956,507 | 10/1960 | Hutchinson . |
| 3,158,104 | 11/1964 | Hutchinson . |
| 3,407,430 | 10/1968 | Renner . |
| 3,820,182 | 6/1974 | Vockroth . |
| 4,094,031 | 6/1978 | Cellini . |
| 4,584,733 | 4/1986 | Tietge et al. . |
| 4,935,015 | 12/1970 | Wilinger . |
| 4,935,980 | 6/1990 | Leginus et al. . |
| 5,095,571 | 3/1992 | Sargent . |
| 5,122,285 | 6/1992 | Tartal . |
| 5,135,647 | 8/1992 | Childers . |
| 5,279,730 | 1/1994 | Chen . |
| 5,311,631 | 5/1994 | Smith, Jr. . |
| 5,384,928 | 1/1995 | Khoury . |

*Primary Examiner*—David A. Simmons
*Assistant Examiner*—Fred Prince
*Attorney, Agent, or Firm*—Trask, Britt & Rossa

[57] ABSTRACT

Debris vacuum device including a suction bulb. In a first embodiment the suction bulb includes a hollow tube with an inlet check valve located at one end and an exhaust check valve located at the opposing end. A screen is provided to extend across the interior of the tube intermediate the ends. By squeezing the walls of the tube, water can be forced out the exhaust check valve with the inlet check valve closed. Then as the flexible walls expand to their original shape, water and debris are drawn into the tube to the inlet check valve while the outlet check valve is closed. In a second embodiment, a bulb having a single opening into the interior is used. An inlet tube for drawing debris and water has one end inserted into the interior of the bulb. The bulb opening is also connected to an exhaust port to allow water to be forced out of the interior of the bulb. An inlet check valve is placed across the inlet tube and an exhaust check valve is placed across the exhaust port. A screen is positioned between the exhaust port and the interior of the bulb and will catch debris that has entered the bulb and is attempting to exit when the bulb is squeezed.

9 Claims, 3 Drawing Sheets

DEBRIS VACUUM DEVICE FOR SPAS/HOT TUBS

This Application claims benefit of Provisional Appln. No. 60/027,264, Sep. 25, 1996.

BACKGROUND

The present invention relates to a debris vacuum device for use with spas/hot tubs and includes a hand-operated device for sucking visible debris into the device and catching the debris in a screen.

It is known that a bulb can be used to create a suction for debris collectors as is shown in U.S. Pat. No. 1,480,562. In this patent, a bulb is used to suck crumbs into a chamber.

Other patents describe stiff, mechanical plungers operating in a hollow cylinder to provide a vacuum type cleaning device. See, for example, U.S. Pat. Nos. 3,820,182, 4,094,031, or 5,122,285.

The present invention is an improvement over the known devices providing a bulb suction device connected to a chamber for collecting debris under water in the bottom of a spa or hot tub. The chamber is provided with two cooperating one-way check valves to allow debris to be sucked into the chamber when the bulb is allowed to expand and to prevent debris from leaving the chamber when the bulb is contracted.

SUMMARY OF INVENTION

In a first embodiment of the present invention, a flexible, hollow tube is used to provide a suction bulb. The tube includes an inlet check valve located at one end and an exhaust check valve at the opposite end. A screen is provided to extend across the interior of the tube intermediate the ends. By squeezing the walls of the tube, water can be forced out the exhaust check valve with the inlet check valve closed. Then as the flexible walls expand to their original shape, water and debris are drawn into the tube through the inlet check valve while the outlet check valve is closed. Debris in the water will then be caught and held in the tube by the screen as water is pumped through the flexible, hollow tube.

In a second embodiment, a bulb, having an open end is used to provide suction. The open end of the bulb is first connected to an inlet tube for drawing debris and water into the interior of the bulb when the bulb is allowed to expand from a contracted position. The bulb opening is also connected to an exhaust port to allow water to be forced out of the interior of the bulb through the exhaust port when the bulb is squeezed. An inlet check valve is placed at the end of the inlet tube positioned inside the bulb and an exhaust check valve is provided in the exhaust port. The inlet check valve is designed to open when the bulb is expanding from a contracted position and close when the bulb is being squeezed. On the other hand, the exhaust check valve is designed to do the opposite, that is open when the bulb is being squeezed and closed when the bulb is being allowed to expand from a contracted position. A screen is positioned between the exhaust port and the interior of the bulb and will catch debris that has entered the bulb and is attempting to exit when the bulb is squeezed.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF THE PREFERRED EMBODIMENTS

Figure 1:
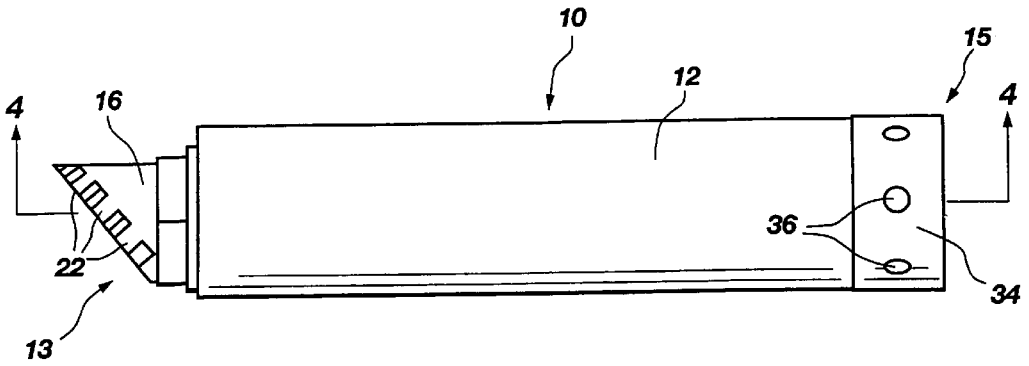
FIG. 1 is an elevational view of a debris vacuum device for spas/hot tubs according to a first embodiment of the present invention.
Figure 2:
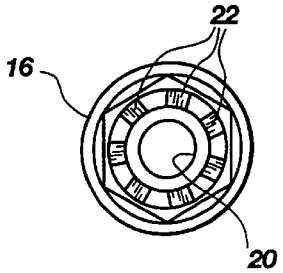
FIG. 2 is a left side view of the device shown in FIG. 1.

A first embodiment of a debris vacuum device 10 is shown in FIG. 1. Debris vacuum device 10 includes a cylindrical-shaped, resilient tube 12, which in a preferred first embodiment is made of rubber, that can be squeezed by an operator's hand to compress the tube and increase pressure in the interior. Device 10 further includes an intake end 13 as seen in FIGS. 1 and 4 and an exhaust end 15.

At the intake end 13 of resilient tube 12, an intake 16 nozzle is provided. This nozzle includes external threads 18 for mating with internal threads 14 of tube 12. As best seen in FIG. 4, intake nozzle 16 is provided with an elongate opening 20 which extends through intake nozzle 16 to the interior of tube 12 to provide a fluid path through nozzle 16. Nozzle 16 further has teeth 22 cut on an angle to the centerline of opening 20 as best seen in FIG. 1. The spacing between teeth 22 is large enough to permit water and debris to flow into opening 20 even though nozzle 16 may touch the bottom or sides of a hot tub at an angle that would normally cut off the flow of water and debris.

A flexible intake check valve 24 is hinged, as by cementing, along one segment 25 of its circumference as at 24 to nozzle 16 where opening 20 enters tube 12. Intake check valve 24 is sized to cover opening 20. When pressure inside tube 12 is greater than the pressure in opening 20, the valve 24 closes opening 20. The valve 24 opens when the pressure differential is reversed.

Figure 4:
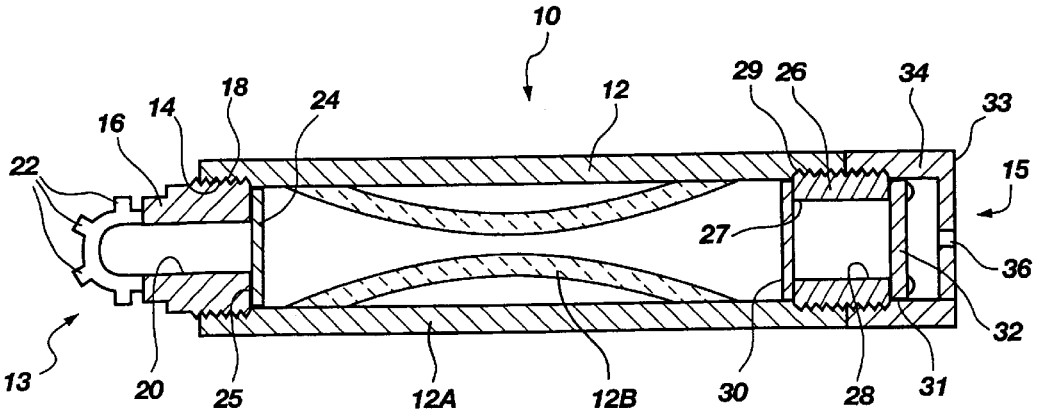
FIG. 4 is a cross-sectional view taken along the line 4—4 in FIG. 1.
Figure 5:
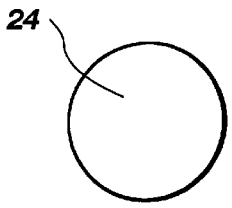
FIG. 5 is a right side view of an intake check valve shown in FIG. 4.
Figure 6:
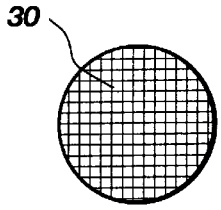
FIG. 6 is a right side view of a screen shown in FIG. 4.
Figure 7:
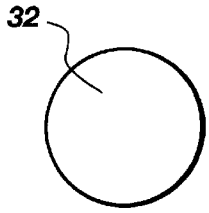
FIG. 7 is a right side view of an exhaust check valve shown in FIG. 4.
Figure 8:
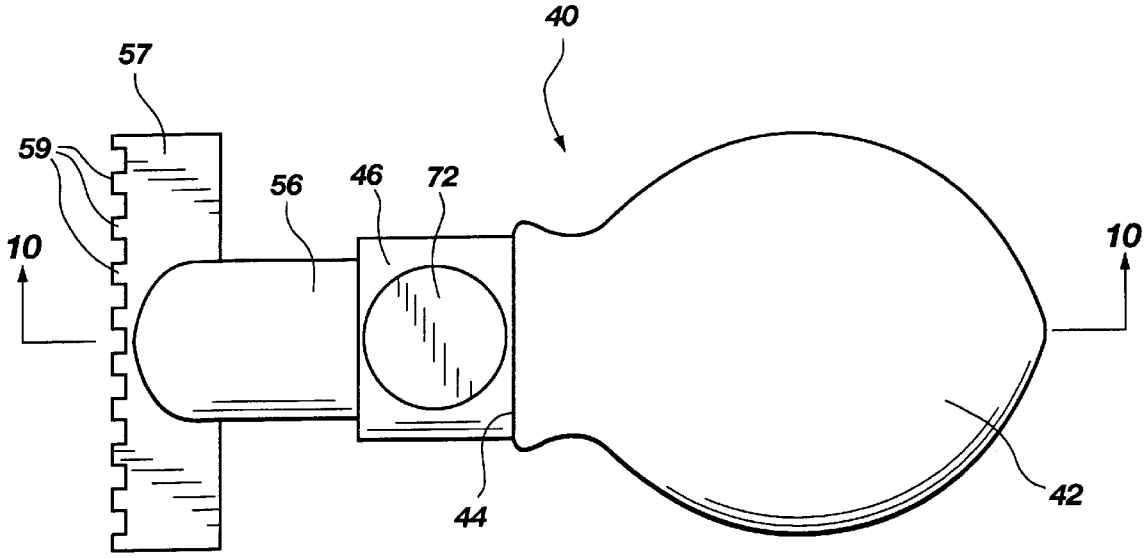
FIG. 8 is a plan view of a second embodiment of the present invention.

As seen in FIG. 4, a tubular adapter 26 is provided with external threads 27 which mate with internal threads 29 of tube 12. Tubular adapter 26 includes a center opening 28 extending through adapter 26. This opening 28 provides a fluid path between opposite ends of the adapter 26. A screen 30 is attached to the adapter 26 by any means well known in the art to cover opening 28. In a preferred first embodiment, screen 30 is cemented to adapter 26.

A flexible exhaust check valve 32 is hingedly connected to adapter 26 as at 31 to cover the opening 28 at the end of adapter 26 opposite screen 30.

Exhaust check valve 32 is sized to cover opening 28. When pressure inside tube 12 is greater than the pressure to the right of valve 32 as shown in FIG. 4, the valve 32 will open. When the pressure differential is reversed the valve 32 will close.

Figure 3:
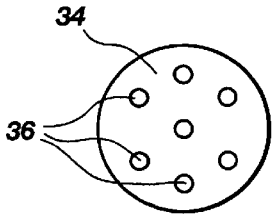
FIG. 3 is a right side view of the device shown in FIG. 1.

An open ended cap 34 having internal threads 33 is screwed on external threads 27 of adapter 26. Cap 34 has holes 36 spaced around the sides and end of the cap, as shown in FIG. 3, to permit water to flow outwardly from the intake side to the exhaust side of the cap.

In operation, an operator places debris vacuum device 10 in a spa or hot tub close to a volume of water where debris has gathered. He then squeezes on resilient tube 12 from at rest position 12A to a deformed or displace position 12B which places pressure on the exhaust side of intake check valve 24, closing the valve. The squeeze also places pressure on the intake side of exhaust check valve 32 which opens this valve and lets water flow through holes 36 in cap 34.

As the operator relaxes his grip on resilient tube 12, the pressure is reduced in the interior of the resilient tube. Intake check valve 24 opens, permitting debris and water to flow into resilient tube 12, and exhaust check valve 32 closes. Screen 30 traps any debris entering resilient tube 12 inside the tube. Then as the operator squeezes resilient tube 12 again which again closes intake check valve 24, the debris remains trapped inside resilient tube 12 between the intake check valve and screen 30, while any water flows through the screen and open exhaust check valve 32 and on out through holes 36 in cap 34.

After a considerable amount of debris has become trapped in resilient tube 12, nozzle 16 can be unscrewed, and the debris washed out of the interior of the resilient tube.

A second embodiment of a debris vacuum device 40 is shown in FIGS. 8 through 12. In this embodiment, an open ended flexible bulb 42, which in the second embodiment is made of rubber, has a single opening 44.

A hollow, elongate body 46 has an inlet opening 48 which is inserted in opening 44 of bulb 42. A ridge 54, as seen in cross-section in FIG. 10, extends around the exterior of body 46 adjacent bulb opening 44 so as to hold a stretched opening 44 of bulb 42 against the body 46 to form an airtight seal between the bulb 42 and the body 46.

An elongate inlet tube 56 has an end 60 inserted through inlet opening 48 of body 46 and opens inside bulb 42. The exterior of inlet tube 56 is cemented in place to body 46 at 48 so as to form a watertight seal between body 46 and tube 56.

Figure 9:
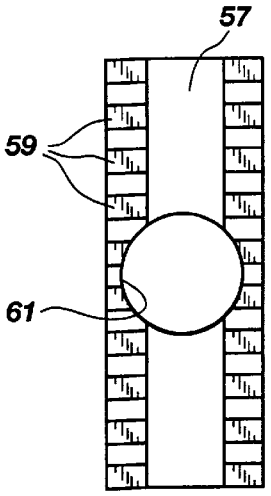
FIG. 9 is an oblique view, taken from the bottom left of FIG. 8 and looking upward and to the right, of the left end of an inlet tube with background parts broken away.
Figure 10:
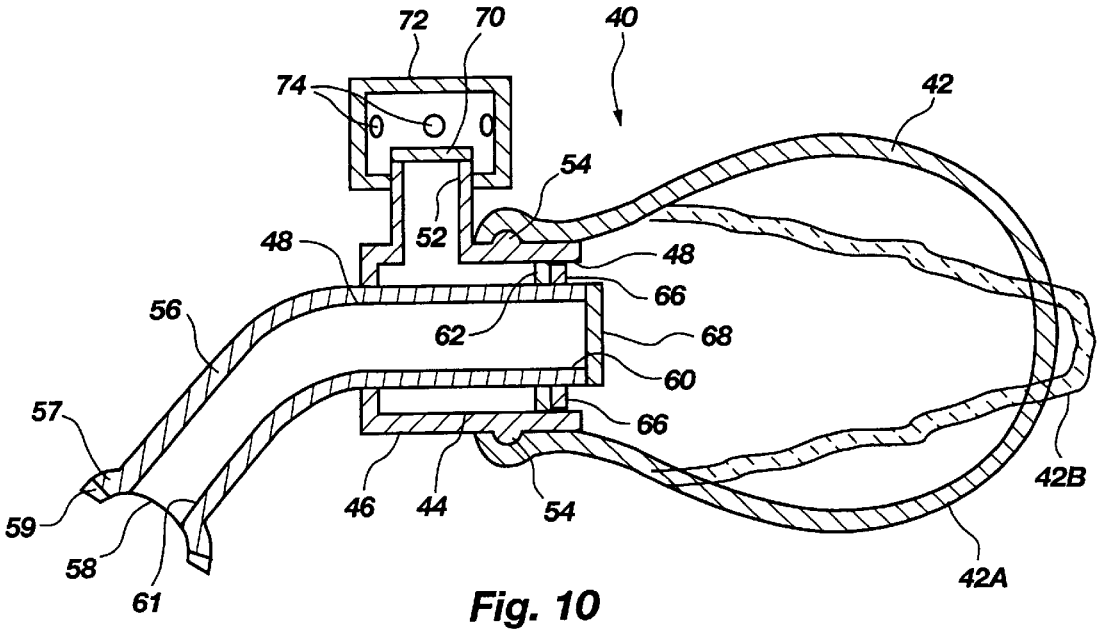
FIG. 10 is a cross-sectional view of the debris vacuum device taken along the line 10—10 in FIG. 8.

An inlet nozzle fitting 57 is attached to tube 56 at the end 58 opposite end 60. Nozzle fitting 57 has a series of teeth 59 extending on opposite sides of the linear fitting as best seen in FIG. 9. In addition, an opening 61 extends through nozzle 57 to provide fluid communication between the surface having teeth 59 and the interior of inlet tube 56, as shown in FIG. 10. Teeth 59 prevent linear fitting 57 from completely covering opening 61 so that debris and water can always pass into debris vacuum device 40 whenever the linear fitting is immersed into a spa or hot tub.

Figure 11:
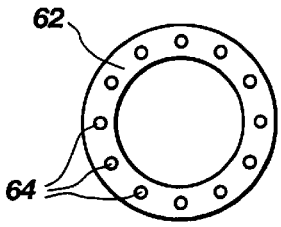
FIG. 11 is a full left side view of a perforated wall shown in cross-section in FIG. 10.

A perforated wall 62 is cemented into place between inlet tube 56 and body 46, as shown in FIG. 10. This wall helps to hold inlet tube 56 in place within bulb 42. Perforated wall 62 has openings 64, as best seen in FIG. 11, which extend through the wall to provide fluid communication between opposite sides of the perforated wall.

Figure 12:
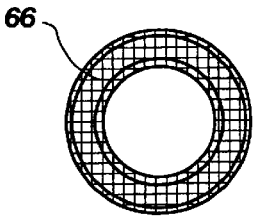
FIG. 12 is a full right side view of a screen shown in cross-section in FIG. 10.

A screen 66, as seen in FIGS. 10 and 12, is positioned adjacent perforated wall 62 on a side facing the interior of bulb 42.

An inlet check valve 68 is placed across inlet tube 56 adjacent second end 60 facing the interior of bulb 42. Inlet valve 68 is constrained to open when the pressure inside bulb 42 is less than the pressure inside tube 56 and close when the pressure differential is reversed.

An exhaust port 52 is provided in hollow body 46 as shown in FIG. 10. An exhaust valve 70 is placed across the hollow interior of exhaust port 52. Exhaust valve 70 is constrained to open when the pressure on the side of valve 70 facing the inside of bulb 42 is greater than the pressure on the exhaust side of valve 70 and to close when the pressure differential is reversed.

Exhaust valve 70 is capped with housing 72, having holes 74 penetrating the housing. With this structure, water exiting exhaust valve 70 can be diverted away from device 40.

In operation, an operator places the second embodiment of debris vacuum device 40 in a spa or hot tub close to a volume of water where debris has gathered. He then squeezes on resilient bulb 42 from at rest position 42A to a deformed position 42B which closes inlet valve 68. The squeeze also opens exhaust valve 70 to let water flow out through holes 74 in housing 72.

As the operator relaxes his grip on bulb 42, the pressure is reduced in the interior of the bulb. Exhaust valve 70 closes, and inlet valve 68 opens, permitting debris and water to flow into bulb 42. Screen 66 traps inside bulb 42 any debris entering the bulb. Then as the operator squeezes bulb 42, again which again closes inlet valve 68 and opens exhaust valve 70, debris remains trapped inside bulb 42 between inlet valve 68 and screen 66. Exiting water flows through screen 66, through open exhaust valve 70, and on out through holes 74 in housing 72.

After a considerable amount of debris has become trapped in bulb 42, the bulb can be slipped off ridge 54, and the debris washed out of the interior of the bulb.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. A portable debris vacuum for use under water, said portable debris vacuum comprising:

a hollow member having an inlet for positioning under water and configured to receive water therethrough and an exhaust for positioning under water and configured for discharging water therethrough, said hollow member being sized to be held by the hand of a user, and said hollow member being formed to define an interior in communication with said inlet and said exhaust, said hollow member being formed of material to be squeezable by the hand of a user between a first position in which said flexible portion is in an at rest position and a second position in which said flexible position is displaced from said first position to urge water into and out of said hollow member through said inlet and out of said hollow member through said exhaust;

an intake check valve positioned proximate said inlet and operable between an open position to allow water to flow into said hollow member and a closed position to inhibit the flow of water to exterior said hollow member;

an exhaust check valve positioned proximate said exhaust and operable between an open position to allow water to flow out of said hollow member and a closed position to inhibit the flow of water to exterior said hollow member;

an intake nozzle for connection to said inlet, said intake nozzle being configured for movement along a surface under water and to aspirate water with entrained debris from said surface toward said inlet upon operation of said hollow member between said first position and said second position;

screen means positioned proximate said exhaust for removing debris from water passing through said hollow member and retain said debris within said hollow member.

2. The portable debris vacuum of claim 1 further including a tubular adapter having an interior in communication with the interior of said member attached proximate the exhaust, and wherein said screen means is positioned to extend over said tubular adapter to inhibit movement of debris from said interior of said tubular adapter to exterior said device.

3. The portable debris vacuum of claim 2 further including a cap configured to attach to one of said member and said tubular adapter, said cap having holes therethrough in communication with said interior of said tubular adapter to receive water therefrom.

4. The portable debris vacuum of claim 3, wherein said nozzle is provided with spaced apart teeth.

5. The portable debris vacuum of claim 2 wherein said intake nozzle is configured to extend into said hollow member and to have an interior face positioned in said interior of said hollow member, and wherein said intake check valve is attached to said intake nozzle on the interior face of said intake nozzle.

6. A portable debris vacuum for use under water, the debris vacuum comprising:

a hollow body having an inlet opening at one end, a bulb opening at an opposite end, and an exhaust port intermediate the inlet opening and the bulb opening, said bulb opening having an interior surface;

a flexible hollow bulb having an opening at one end sized to connect to hollow body to have said bulb opening and said exhaust port there within;

an inlet tube having an inlet end and a second end, the second end being inserted through said inlet opening of said hollow body and said second end having an exterior surface;

a perforated wall positioned proximate said second end of said inlet tube to extend between said exterior surface of said inlet tube to the interior surface of said bulb opening of said hollow body;

an inlet check valve positioned relative to said second end and operable between a closed position and an open to regulate the flow of water into said flexible hollow bulb from said inlet tube;

a screen positioned against said perforated wall and sized to catch debris; and an exhaust check valve positioned relative to said exhaust port to regulate the flow of water from said hollow flexible bulb.

7. The debris vacuum of claim 6 further including a housing having holes therethrough attached to said hollow body proximate said exhaust port to receive a flow from said exhaust port.

8. The debris vacuum of claim 7 further including a nozzle fitted to said inlet end of said inlet tube, said nozzle having a series of spaced apart teeth extending outwardly from said nozzle.

9. A vacuum for use under water, said vacuum comprising:

a body having an inlet and an outlet;

a bulb having a bulb opening configured to connect to said body with said inlet and said outlet in said bulb opening;

an inlet check valve positioned relative to said inlet to regulate the flow of water into said bulb through said bulb opening and operable to be open when the pressure of said water is greater than the pressure in the interior of said bulb;

an outlet check valve positioned relative to said outlet to regulate the flow of water from said bulb and operable to be open when the pressure in the interior of said bulb is greater than the pressure of said water exterior to said outlet check valve;

a screen positioned proximate said bulb opening and between said inlet check valve and said outlet check valve to remove debris from said water before passing through said outlet check valve;

said bulb being operable to cause water to enter said bulb through said inlet check valve means and to urge water out through said outlet check valve.

* * * * *